US009650827B2

(12) United States Patent
Beeson

(10) Patent No.: US 9,650,827 B2
(45) Date of Patent: May 16, 2017

(54) GARAGE DOOR ROLLER SYSTEM

(71) Applicant: Howard Jay Beeson, Hoover, AL (US)

(72) Inventor: Howard Jay Beeson, Hoover, AL (US)

( * ) Notice: Subject to any disclaimer, the term of this patent is extended or adjusted under 35 U.S.C. 154(b) by 0 days.

(21) Appl. No.: 14/922,402

(22) Filed: Oct. 26, 2015

(65) Prior Publication Data

US 2016/0115723 A1 Apr. 28, 2016

Related U.S. Application Data

(60) Provisional application No. 62/069,071, filed on Oct. 27, 2014.

(51) Int. Cl.

| | |
|---|---|
| ***E05F 15/681*** | (2015.01) |
| ***E06B 7/28*** | (2006.01) |
| ***E05D 15/24*** | (2006.01) |
| *E05D 13/00* | (2006.01) |

(52) U.S. Cl.

CPC ..... *E05F 15/681* (2015.01); *E05D 15/244* (2013.01); *E06B 7/28* (2013.01); *E05D 13/00* (2013.01); *E05Y 2800/406* (2013.01); *E05Y 2800/70* (2013.01); *E05Y 2900/106* (2013.01)

(58) Field of Classification Search

CPC ..... E05F 15/668; E05F 15/67; E05F 15/681; E05F 15/684; E05F 15/686

See application file for complete search history.

(56) References Cited

U.S. PATENT DOCUMENTS

| | | | | | |
|---|---|---|---|---|---|
| 2,084,733 | A * | 6/1937 | Kahliff | E05F 15/684 | 49/199 |
| 3,280,508 | A * | 10/1966 | Dugger | E05F 15/686 | 49/200 |
| 3,289,350 | A * | 12/1966 | Moody | E05F 15/67 | 160/188 |
| 3,364,974 | A * | 1/1968 | Wiegand | E05F 15/686 | 160/188 |
| 3,616,575 | A * | 11/1971 | Harris | E05F 15/684 | 160/193 |
| 3,851,125 | A * | 11/1974 | Deming | E05F 15/673 | 200/47 |
| 4,191,237 | A * | 3/1980 | Voege | E05F 15/686 | 160/188 |
| 4,611,430 | A * | 9/1986 | Altrogge | E05F 15/686 | 49/199 |
| 4,734,076 | A * | 3/1988 | Goldstein | A63H 17/44 | 446/4 |
| 6,176,039 | B1 * | 1/2001 | Craig | E05F 15/43 | 49/197 |

(Continued)

*Primary Examiner* — Gregory Strimbu
(74) *Attorney, Agent, or Firm* — Neustel Law Offices

(57) ABSTRACT

A garage door roller system for preventing damage to a vehicle or a garage door when the garage door is opening or closing. The garage door roller system generally includes a garage door arm which is connected at an upper end thereof to a carriage of a garage door opener. A first end of a connector is connected to the garage door arm, and a second end of the connector is connected to the garage door. One or more rollers are connected to a lower end of the garage door arm, with a portion of the rollers being positioned lower than the lower end of the garage door arm. The rollers are adapted to roll across an obstruction when the garage door is opening or closing to prevent damage to the obstruction as well as the garage door arm.

9 Claims, 10 Drawing Sheets

(56) References Cited

U.S. PATENT DOCUMENTS

| | | | | |
|---|---|---|---|---|
| 7,017,643 | B2 * | 3/2006 | Leum | E06B 11/00<br>160/113 |
| 2005/0107040 | A1 * | 5/2005 | Oberhauser | E05F 15/76<br>455/70 |

* cited by examiner

GARAGE DOOR ROLLER SYSTEM

CROSS REFERENCE TO RELATED APPLICATIONS

I hereby claim benefit under Title 35, United States Code, Section 119(e) of U.S. provisional patent application Ser. No. 62/069,071 filed Oct. 27, 2014. The 62/069,071 application is currently pending. The 62/069,071 application is hereby incorporated by reference into this application.

STATEMENT REGARDING FEDERALLY SPONSORED RESEARCH OR DEVELOPMENT

Not applicable to this application.

BACKGROUND OF THE INVENTION

Field of the Invention

The present invention relates generally to a roller system and more specifically it relates to a garage door roller system for preventing damage to a vehicle or garage door due to obstructions when the door is opening or closing.

Description of the Related Art

Any discussion of the related art throughout the specification should in no way be considered as an admission that such related art is widely known or forms part of common general knowledge in the field.

Garage doors are in use throughout the world. Very often, garage doors are operated either from within the vehicle itself or from a separate controller, such as mounted to a wall. In either case, it is very common for one to inadvertently open or close a garage door when there is some sort of obstruction which will block it from fully opening or closing. To prevent injury, most garage doors sense torque levels and will reverse the garage door from opening or closing when a certain level of torque is detected. However, at the point when torque is detected, the garage door will often have already contacted an obstruction and, in many cases, either damages the obstruction or the garage door itself. Many garage doors include a steel arm which connects a carriage of the opener with the garage door itself. Very often, this steel arm extends downwardly and has a lower overhead clearance than any other part of the garage door. In situations in which the steel arm contacts another object, such as a hatch of a vehicle, serious damage can be done. Vehicles often have a high profile, particularly if they have a rear hatch lift gate that when open, exceeds the clearance between the opener arm and the vehicle hatch/lift gate, resulting in damage if contact is made.

It is very common to accidentally leave a hatch or lift gate of a vehicle open, such as when emptying groceries, and then forget to close the hatch or lift gate before activating the garage door. In these cases, the steel arm of the garage door will have already damaged the vehicle, such as by leaving a scratch, before a higher torque is detected and the garage door reversed. In fact, the reversal of the garage door can actually cause even more damage to the vehicle since the steel arm will contact the vehicle again on the way back up or down.

Because of the inherent problems with the related art, there is a need for a new and improved garage door roller system for preventing damage due to obstructions when the door is opening or closing.

BRIEF SUMMARY OF THE INVENTION

Provided herein is a garage door roller system which includes a garage door arm which is connected at its upper end to a carriage of a garage door opener. A connector is connected to the garage door arm, with a first portion extending along the garage door arm and a second portion extend away from the garage door arm at a right angle. The second end of the connector is connected to a garage door such as by a bracket. One or more rollers are freely rotatable about the lower end of the garage door arm, with the lower ends of the rollers being positioned lower than the lower end of the garage door arm. The rollers are adapted to roll across any obstruction present when the garage door is opening or closing to prevent damage to the obstruction as well as the garage door arm.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
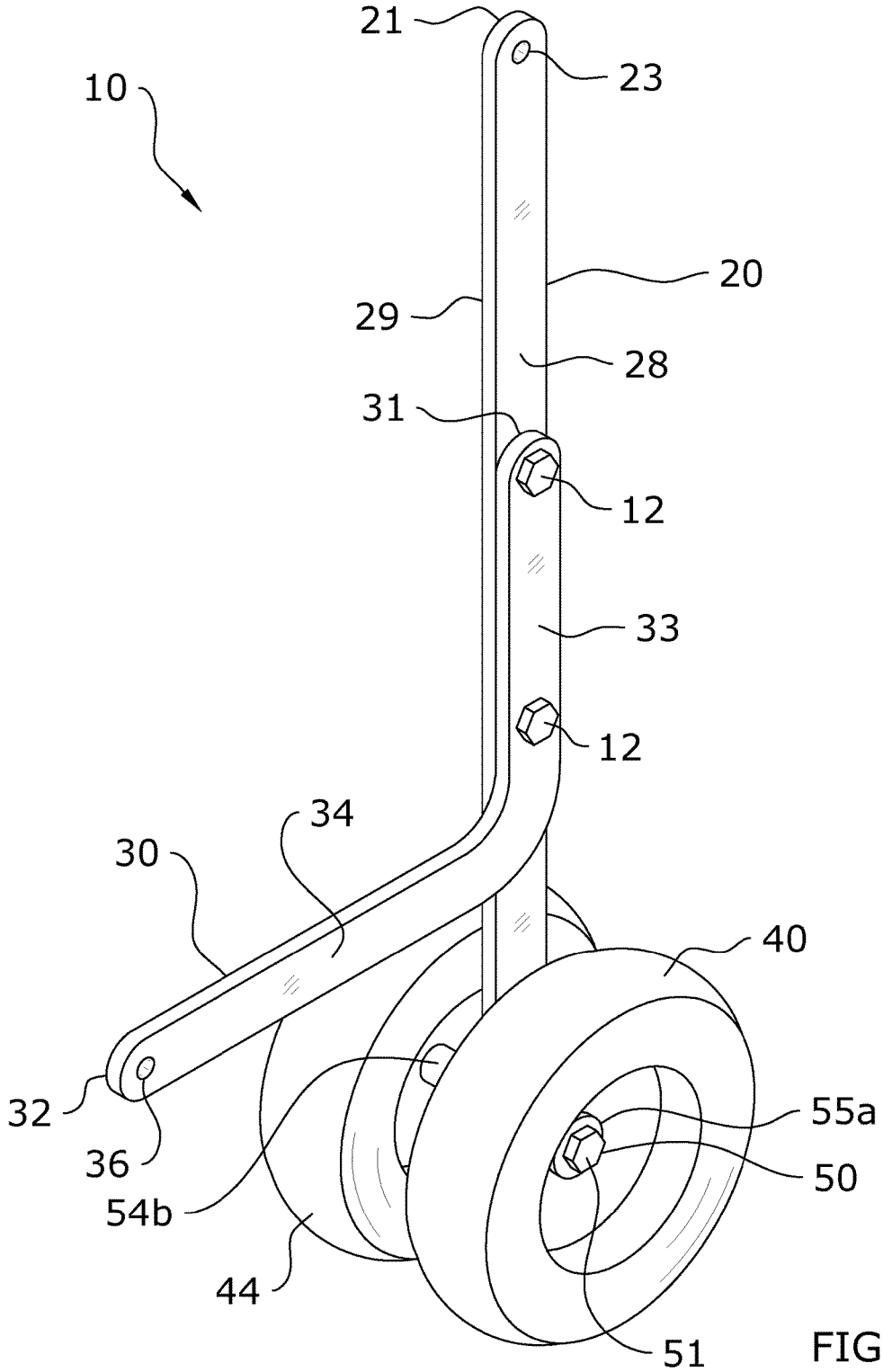
FIG. 1 is an upper perspective view of the present invention.

A. Overview.

Turning now descriptively to the drawings, in which similar reference characters denote similar elements throughout the several views, FIGS. 1 through 10 illustrate a garage door roller system 10, which comprises a garage door arm 20 which is connected at its upper end 21 to a carriage 15 of a garage door opener 14. A connector 30 is connected to the garage door arm 20, with a first portion 33 extending along the garage door arm 20 and a second portion 34 extend away from the garage door arm 20 at a right angle. The second end 32 of the connector 30 is connected to a garage door 17 such as by a bracket 18. One or more rollers 40, 44 are freely rotatable about the lower end 22 of the garage door arm 20, with the lower ends of the rollers 40, 44 being positioned lower than the lower end 22 of the garage door arm 20. The rollers 40, 44 are adapted to roll across any obstruction 60 present when the garage door 17 is opening or closing to prevent damage to the obstruction 60 as well as the garage door arm 20.

The figures illustrate that the obstruction 60 comprises a vehicle or a hatch 62. It should be appreciated that the present invention may function with various types of obstructions 60 and thus the scope of the present invention should not be limited to vehicles 60 with hatches 62. For example, the present invention would function with any obstruction 60 of high enough clearance to block normal operation of the garage door 17, such as but not limited to boats, airplanes, boxes, shelving, boxes, and the like.

B. Garage Door Arm.

As best shown in FIG. 1, the garage door arm 20 will generally comprise an elongated member such as a rod or the like which includes an upper end and a lower end. The garage door arm 20 is illustrated as being comprised of a straight configuration without turns or bends, but it should be appreciated that other configurations may be utilized in which the garage door arm 20 includes bends or turns.

Figure 5:
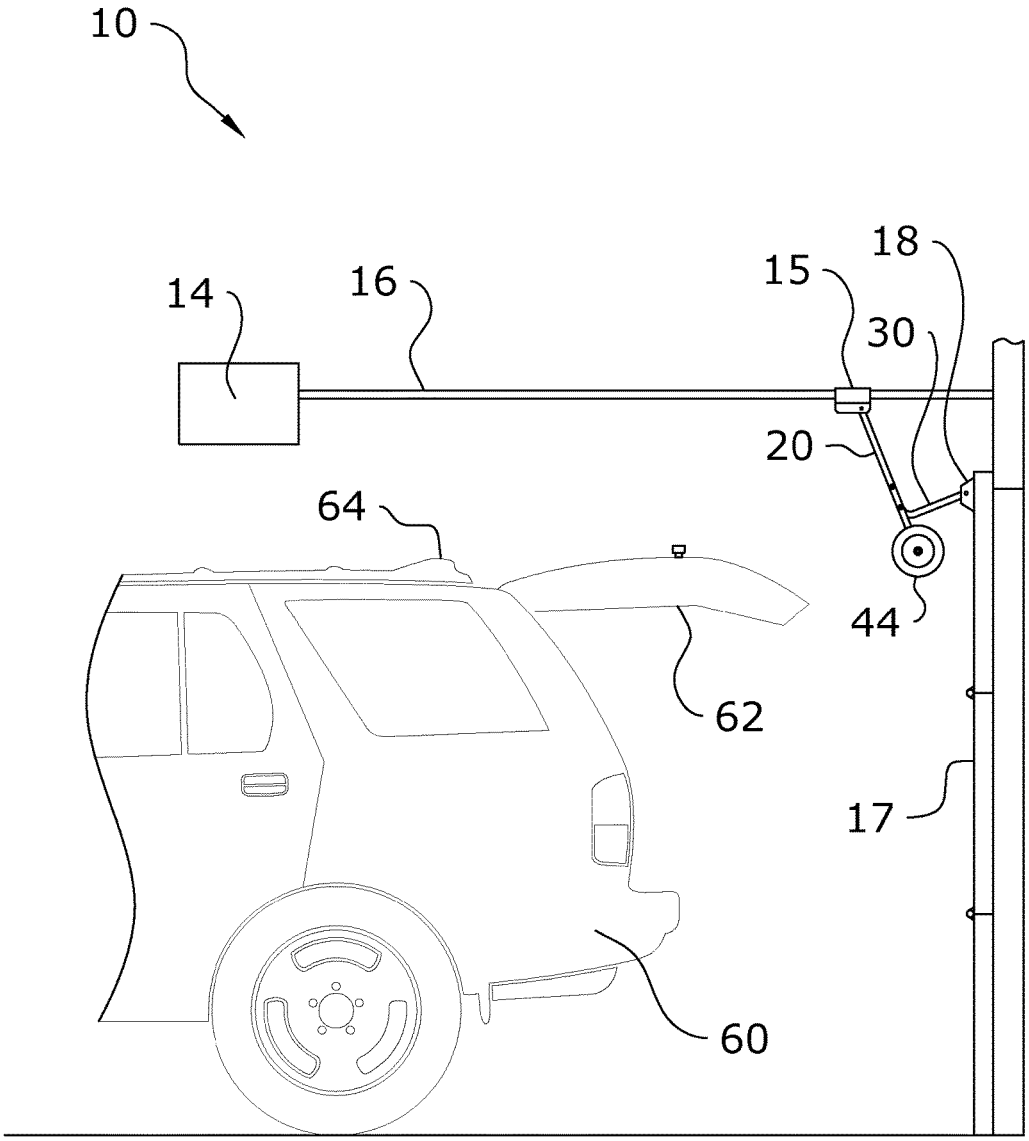
FIG. 5 is a side view of the present invention in use with the garage door closed.

As shown in FIG. 5, the upper end 21 of the garage door arm 20 is generally connected to a carriage 15 of a garage door opener 14. In preferred embodiments, the upper end 21 of the garage door arm 20 is pivotally connected to the carriage 15. This pivotal connection ensures that the upper end 21 of the garage door arm 20 may freely pivot with respect to the carriage 15 when the carriage 15 is in motion along a track 16.

Figure 2:
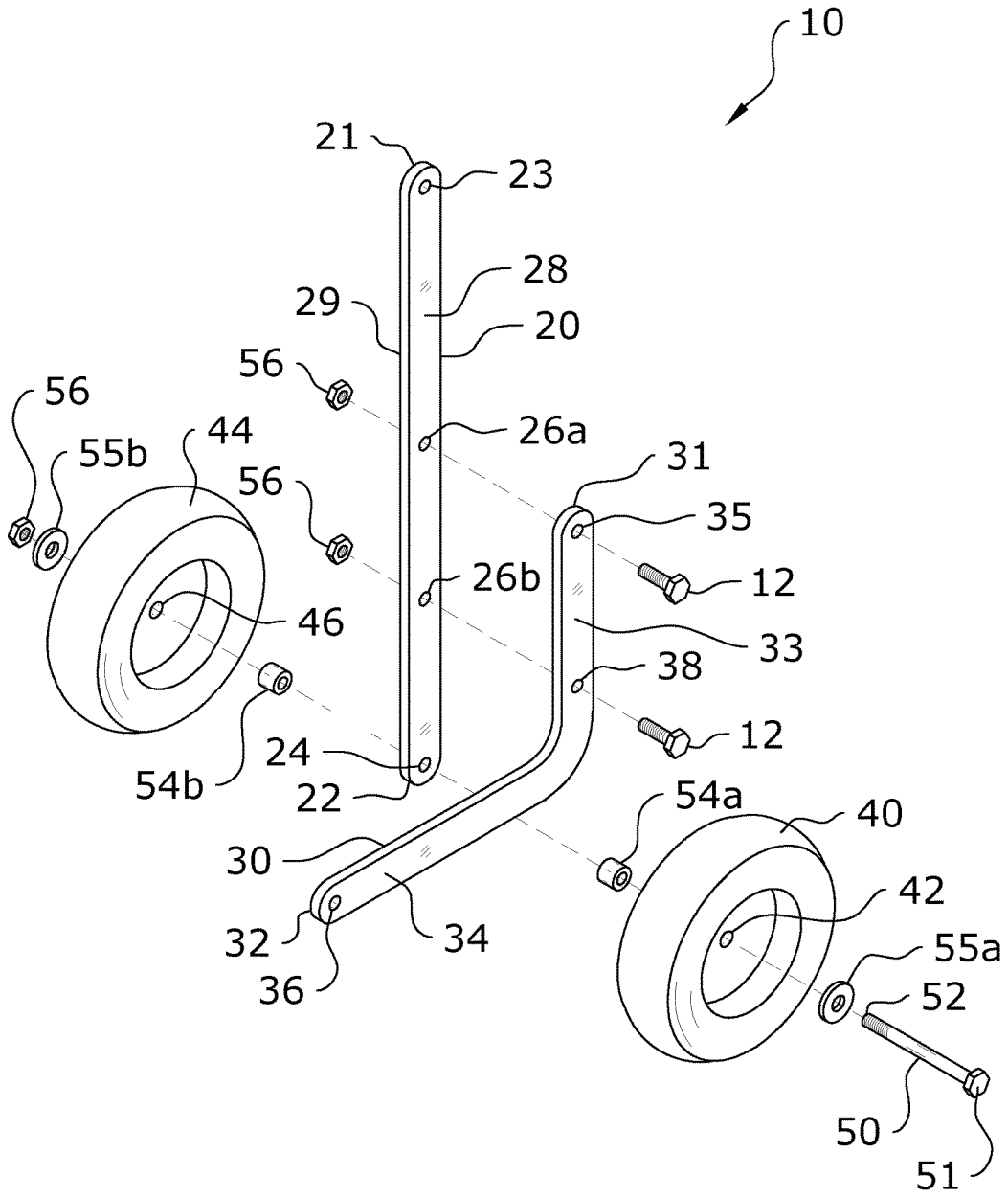
FIG. 2 is an exploded upper perspective view of the present invention.

As shown in FIG. 2, the upper end 21 of the garage door arm 20 includes an upper opening 23. A fastener 12 such as a pivot pin or the like may be inserted through the upper opening 23 of the garage door arm 20 to connect the upper end 21 of the garage door arm 20 to the carriage 15.

Figure 3:
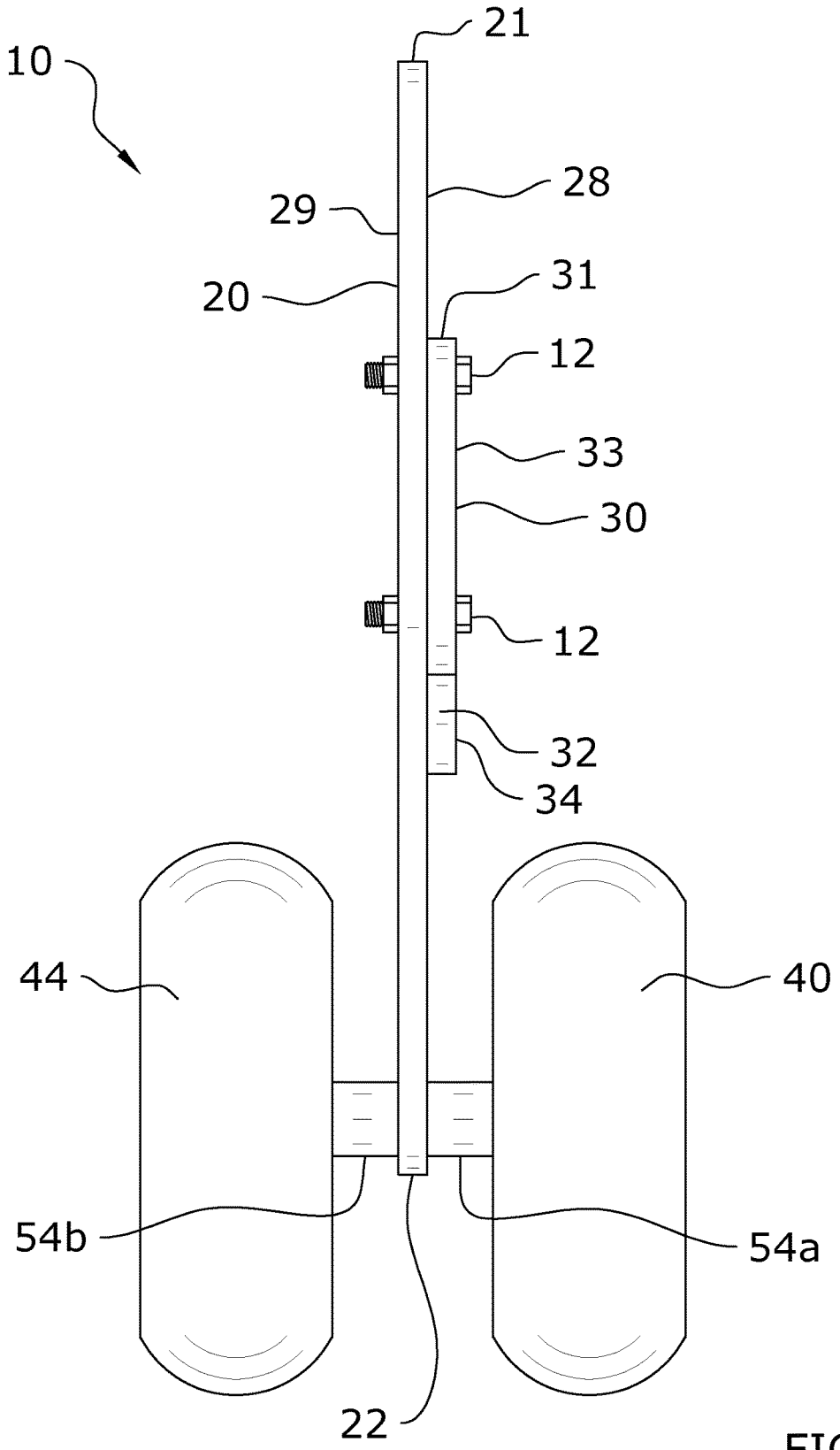
FIG. 3 is a frontal view of the present invention.

As shown in FIG. 3, the lower end 22 of the garage door arm 20 extends below the connector 30 of the present invention. One or more rollers 40, 44 such as wheels are connected to the lower end 22 of the garage door arm 20 such that the lower ends of the rollers 40, 44 extend below the lower end 22 of the garage door arm 20. The lower end 22 of the garage door arm 20 may include a lower opening 24 to which the rollers 40, 44 are connected, such as by an axle 50 extending through the lower opening 24 of the garage door arm 20. In a preferred embodiment as shown in FIG. 3, the first roller 40 is connected to a first side 28 of the lower end 22 of the garage door arm 20 and the second roller 44 is connected to a second side 29 of the lower end 22 of the garage door arm 20.

As shown in FIG. 2, the garage door arm 20 may include one or more first connector openings 26 which are utilized to connect the connector 30 to the garage door arm 20. In a preferred embodiment, the garage door arm 20 includes a pair of first connector openings 26*a*, 26*b* which are both positioned between the upper and lower openings 23, 24 of the garage door arm 20. In a preferred embodiment as shown in FIG. 2, one of the first connector openings 26*a* is positioned at the midpoint of the garage door arm 20 and the other first connector opening 26*b* at the midpoint between the lower end 22 of the garage door arm 20 and the midpoint between the upper and lower ends 21, 22 of the garage door arm 20.

C. Connector.

FIGS. 1-3 best illustrate an exemplary connector 30 used with the present invention which has a first end 31 and a second end 32. The connector 30 of the present invention is utilized to interconnect the garage door arm 20 with the garage door 17 as shown in FIG. 5. The garage door 17 may include a bracket 18 to which the connector 30 is connected.

As shown, the connector 30 may comprise a first portion 33 extending in a first direction and a second portion 34 extending in a second direction. When connected to the garage door arm 20 as shown in FIG. 1, the first portion 33 extends along the length of the garage door arm 20 and the second portion 34 extends at a right angle with respect to the garage door arm 20. The connector 30 and garage door arm 20 are interconnected such that the lower end 22 of the garage door arm 20 extends below the connector 30 as shown in FIG. 1.

In some embodiments, the connector 30 will comprise an L-shaped configuration in which the second portion 34 extends at a right angle with respect to the first portion 33. Other angles may be utilized for different embodiments of the present invention, and thus the exemplary configuration shown in the figures should not be construed as limiting on the scope of the present invention.

The first end 31 of the connector 30 will generally be on the first portion 33 and the second end 32 of the connector 30 will generally be on the second portion 34 as shown in FIG. 1. The connector 30 will generally include three openings 35, 36, 38 as shown in FIG. 2. The first opening 35 of the connector 30 is located near or at its first end 31. The first opening 35 of the connector 30 is generally aligned with the first connector opening 26*a* of the garage door arm 20 to secure the connector 30 to the garage door arm 20.

The second opening 36 of the connector 30 is located at or near its second end 32 as shown in FIG. 2. The second opening 26 of the connector 30 is generally utilized to connect the second end 32 of the connector 30 to the garage door 17, such as by using a bracket 18 and fasteners 12. The second end 32 of the connector 30 may be pivotally or non-pivotally connected to the garage door 17 depending on the embodiment of the present invention.

In many embodiments, the connector 30 will include a second connector opening 38 which is adapted to be aligned with the first connector opening 26*b* of the garage door arm 20 to secure the connector 30 against the garage door arm 20. The second connector opening 38 is generally positioned approximately one-quarter of the length up the connector 30 from its second end 32 to its first end 31 as shown in FIG. 2.

In most embodiments such as shown in FIG. 2, the connector 30 will include three discrete openings: a first opening 35 at or near its first end 31 for connecting to the first connector opening 26*a*, a second opening 36 at or near its second end 32 for connecting to the bracket 18 of the garage door 17, and a second connector opening 38 between the first and second openings 35, 36 for connecting to the first connector opening 26*b*.

D. Rollers.

As shown throughout the figures, the present invention utilizes one or more rollers 40, 42 which are adapted to contact and roll along an obstruction 60 such as a vehicle for prevention of damage to the obstruction 60. While the figures illustrate that the rollers 40, 42 comprise wheels, it should be appreciated that other configurations may be utilized for different applications. In some embodiments, the rollers 40, 42 may comprise rubber bumpers or the like which do not roll, but instead slide along the surface of the obstruction 60. In a preferred embodiment, the rollers 40, 42 comprise wheels made of a rubber or other malleable material which is not likely to damage a surface when rolling across it.

The rollers 40, 44 of the present invention are generally connected to the lower end 22 of the garage door arm 20 for rolling across a surface of an obstruction 60 to prevent damage to the obstruction 60. The rollers 40, 44 will thus preferably each extend below the lower end 22 of the garage door arm 20 such that the rollers 40, 44 prevent the garage door arm 20 or any portion thereof from contacting the obstruction 60.

The figures illustrate usage of a first roller 40 and a second roller 44. More or less rollers 40, 44 may be utilized in different embodiments. An exemplary embodiment in which two rollers 40, 44 are utilized is shown in FIG. 1. As shown, the lower ends of the rollers 40, 44 each extend below the lower end 22 of the garage door arm 20. Preferably, the first roller 40 is connected to a first side 28 of the lower end 22 of the garage door arm 20 and the second roller 44 is connected to a second side 29 of the lower end 22 of the garage door arm 20 as shown in FIG. 3.

Figure 4:
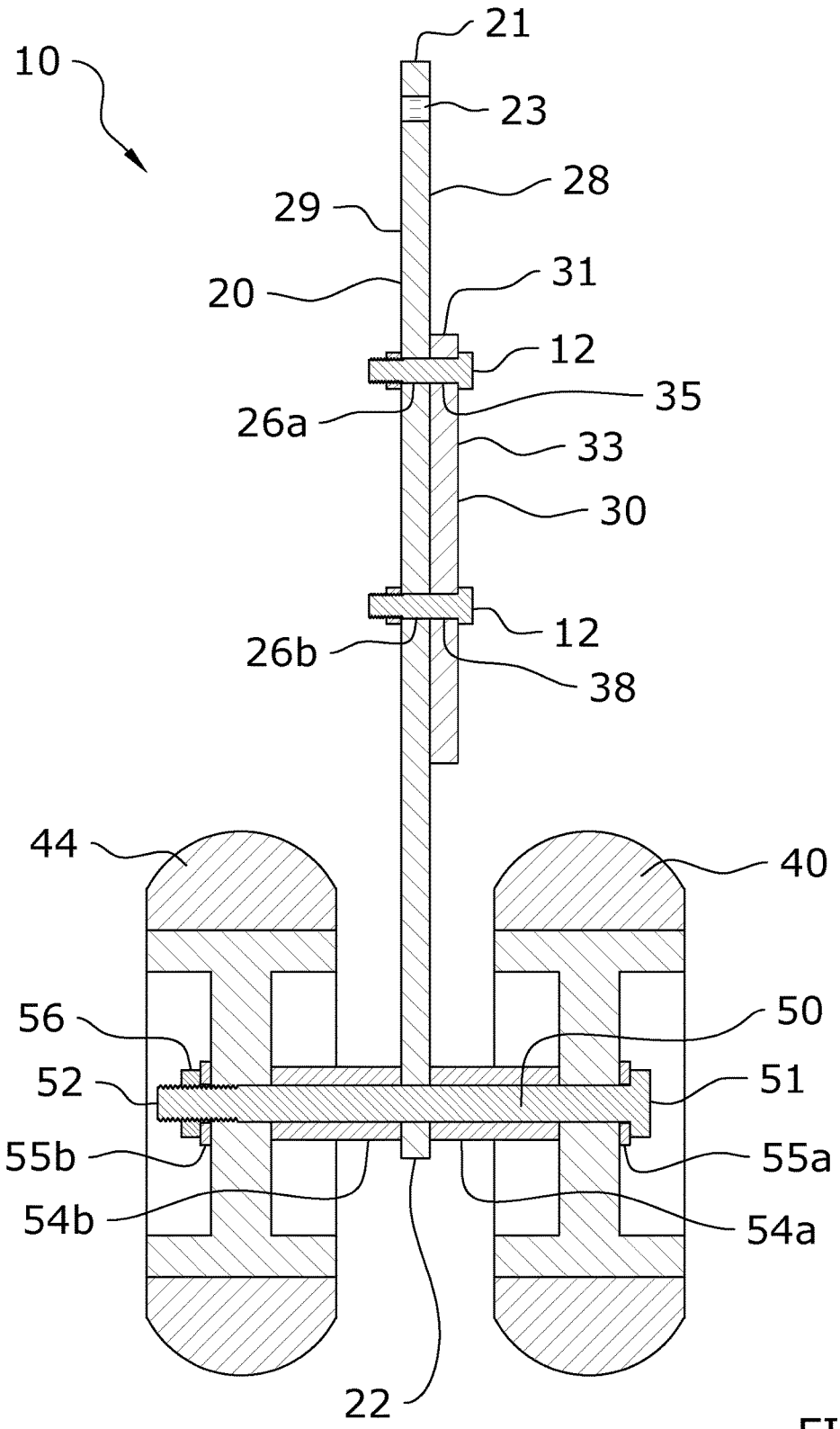
FIG. 4 is a sectional view of the present invention.

FIG. 4 provides an exemplary illustration of how the rollers 40, 44 are connected to the garage door arm 20. It should be appreciated that this exemplary configuration is not meant to be limiting, and there are multiple other manners in which the rollers 40, 44 may be connected to the lower end 22 of the garage door arm 20. Preferably, the rollers 40, 44 are freely rotatable about the lower end 22 of the garage door arm 20 so that they may freely roll across the obstruction 60.

In the embodiment shown in FIG. 2, the first roller 40 includes a first roller opening 42 at its center point. The second roller 44 similarly includes a second roller opening 46 at its center point. It is preferable to attach the rollers 40, 44 via a central point on their body so that the lower ends of the rollers 40, 44 extend below the lower end 22 of the garage door arm 20. This configuration ensures that no portion of the garage door arm 20 contacts or damages the obstruction 60 when the present invention is in use.

Preferably, an axle 50 is provided which extends through the first roller opening 42 of the first roller 40, the lower opening 24 of the garage door arm 20, and the second roller opening 46 of the second roller 44. The first end 51 of the axle 50 is secured against the outer surface of the first roller 40 while the second end 52 of the axle 50 is secured against the outer surface of the second roller 40. Spacers 54*a*, 54*b* may be utilized to ensure that no parts of the rollers 40, 44 are in contact with the garage door arm 20 or connector 30. As shown in FIG. 2, a first spacer 54*a* may be utilized between the first roller 40 and the first side 28 of the garage door arm 20 and a second spacer 54*b* may be utilized between the second roller 44 and the second side 29 of the garage door arm 20. Spacers 54*a*, 54*b* may be omitted in some embodiments of the present invention.

Similarly, optional washers 55*a*, 55*b* may be included. A first washer 55*a* may be positioned between the first end 51 of the axle 50 and the first roller 40 and a second washer 55*b* may be positioned between the second end 52 of the axle 50 and the second roller 44. A lock nut 56 or other type of fastening device may be utilized to secure the axle 50 in place, such as using threading on the second end 52 of the axle 50 as shown in FIG. 2.

E. Operation of Preferred Embodiment.

Figure 9:
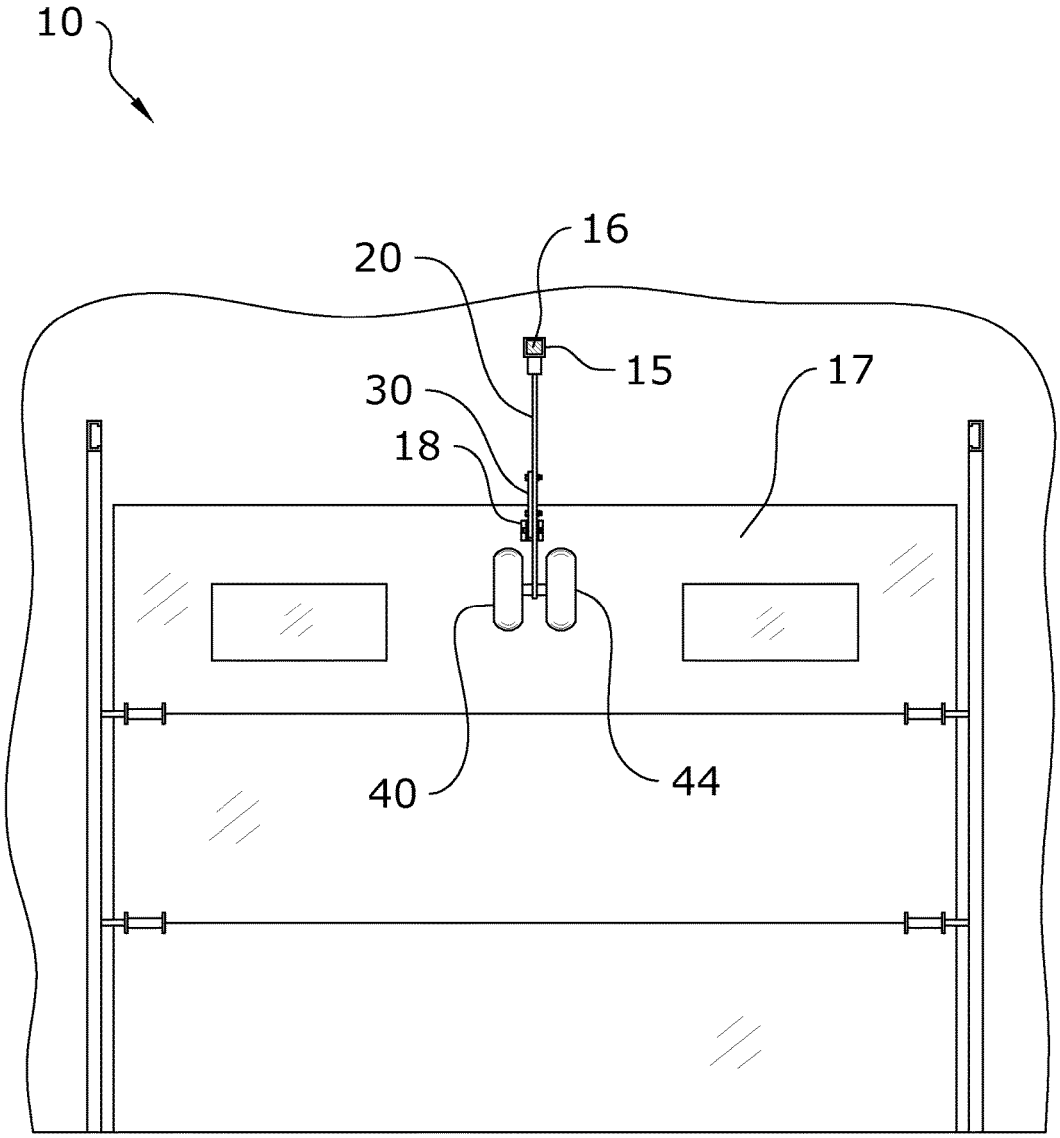
FIG. 9 is a frontal view of the present invention installed with a garage door.
Figure 10:
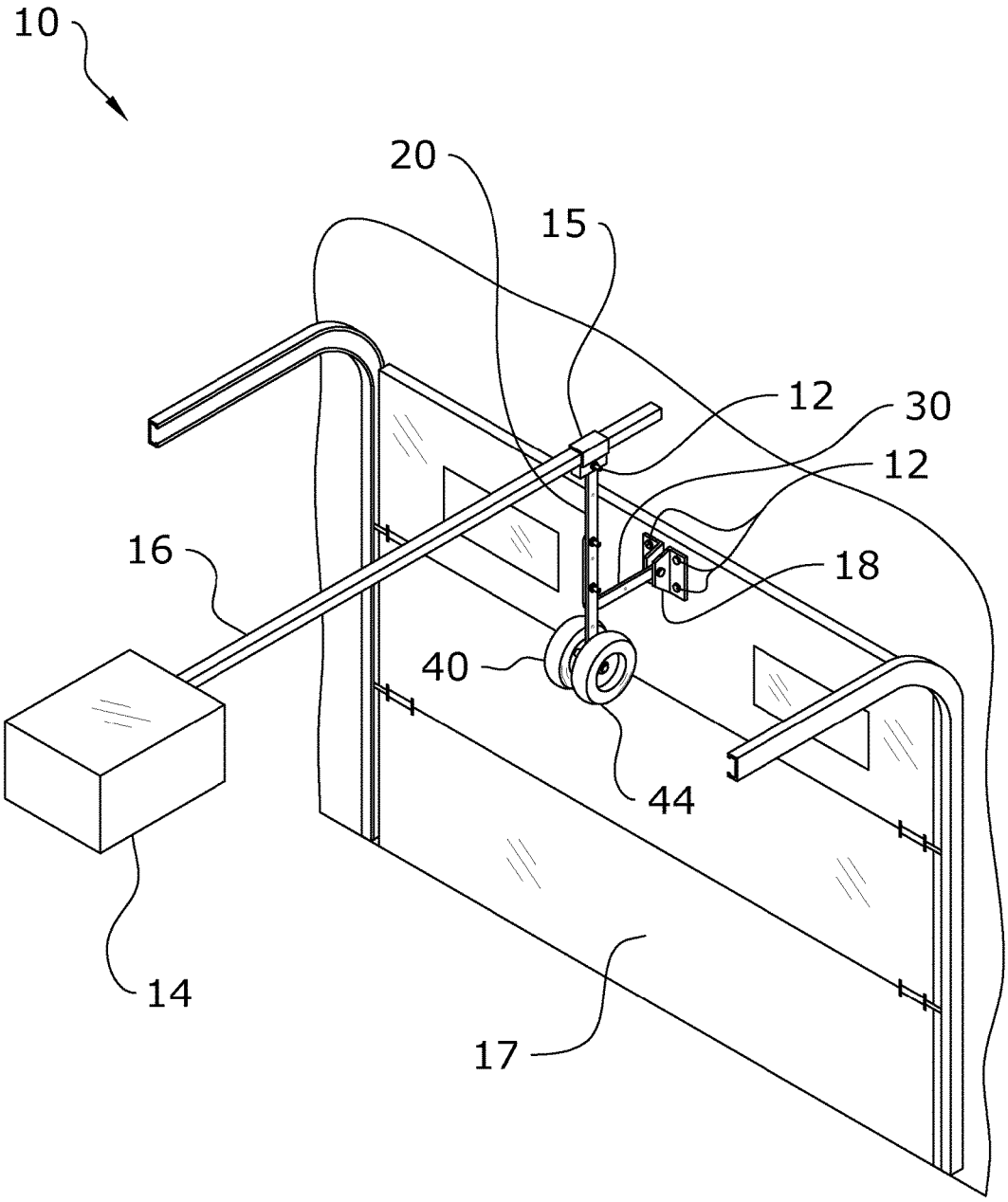
FIG. 10 is an upper perspective view of the present invention installed with a garage door.

In use, the garage door arm 20 is first secured to the carriage 15 of the track 16 of the garage door opener 14 as shown in FIGS. 9 and 10. The upper opening 23 at the upper end 21 of the garage door arm 20 is pivotally connected to the carriage 15, such as by a fastener 12. The connector 30 may then be connected to the garage door arm 20. The first opening 35 of the connector 30 is aligned with the first connector opening 26*a* of the garage door arm 20 and secured thereto with a fastener 12. The second connector opening 38 of the connector 30 is similarly aligned with the first connector opening 26*b* of the garage door arm 20 and secured thereto with a fastener 12.

At this point, the garage door arm 20 is pivotally connected to the carriage 15 of the garage door opener 14 and the connector 30 is connected to the garage door arm 20. The connector 30 may then be connected to the garage door 17. The second opening 36 of the connector 30 will generally be aligned with a mounting point such as a bracket 18 on the garage door 17 and secured thereto, either pivotally or non-pivotally, with a fastener 12 as shown in FIG. 5.

With the garage door arm 20 and connector 30 fully installed as shown in FIG. 5, the rollers 40, 44 may be added to the lower end 22 of the garage door arm 20. In some embodiments, this step will not be necessary as the garage door arm 20 will have already come with attached rollers 40, 44. In other embodiments, the end-user may install the rollers 40, 44 to the garage door arm 20.

Figure 6:
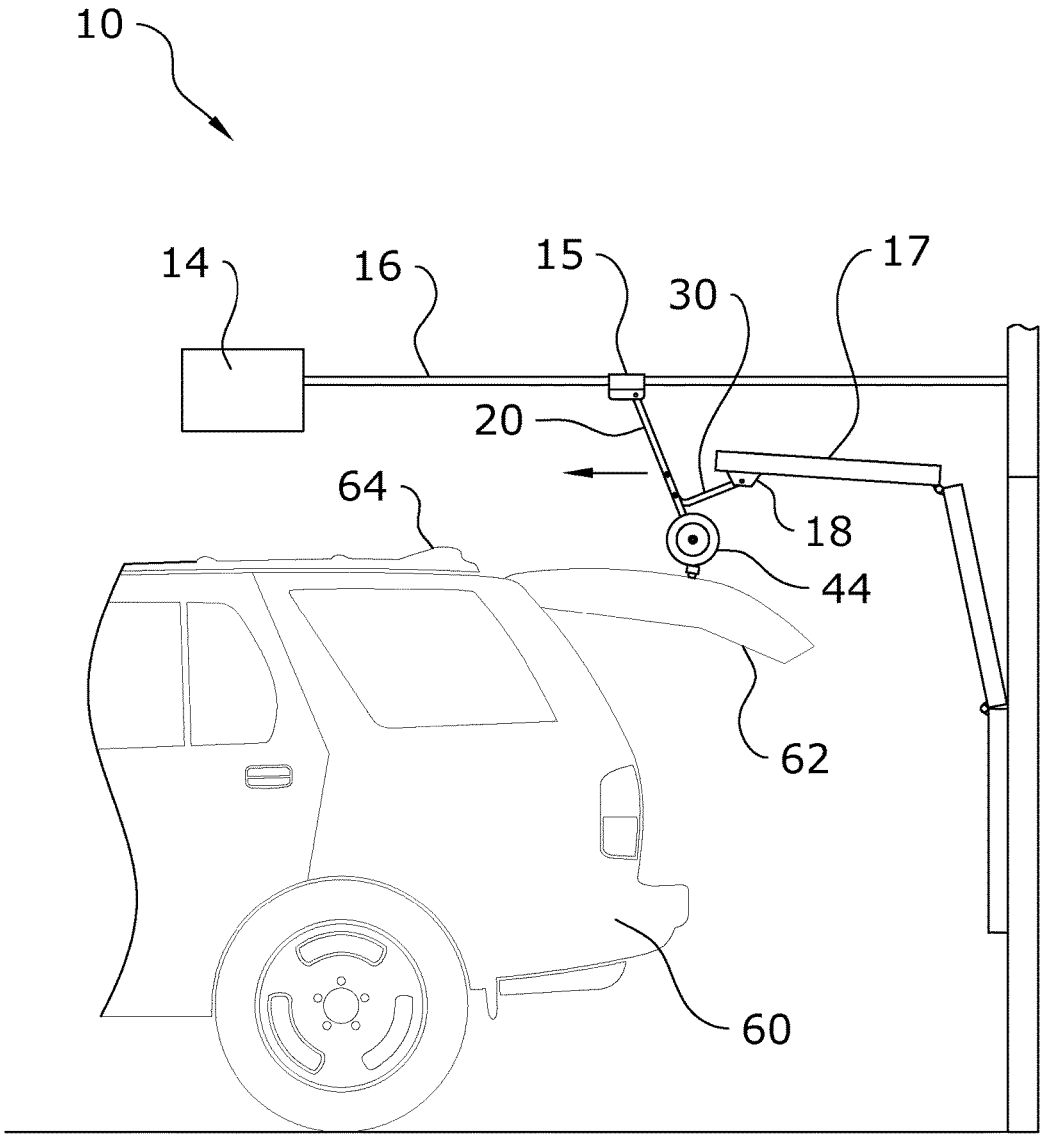
FIG. 6 is a side view of the present invention rolling over the extended hatch of a vehicle.
Figure 7:
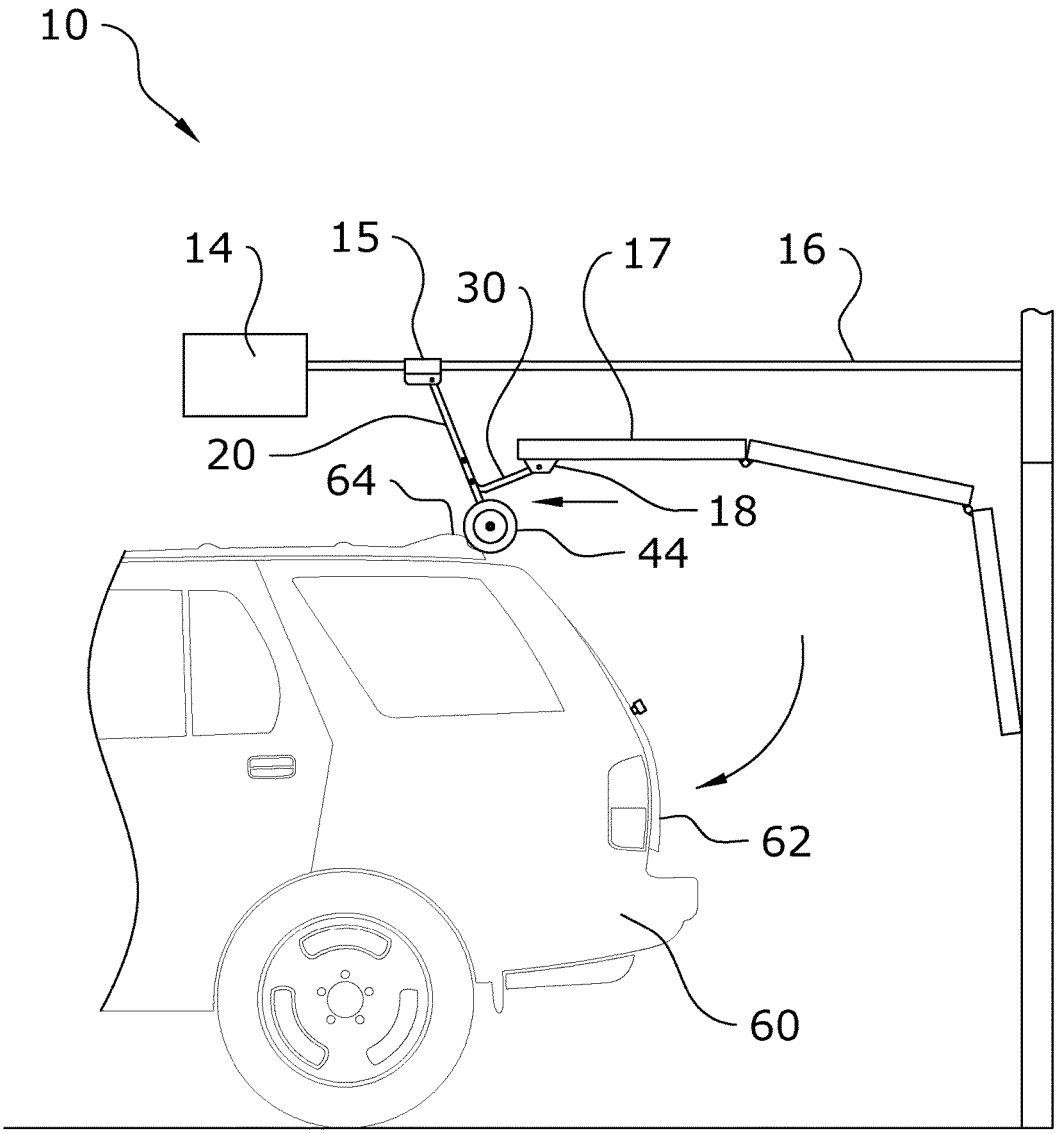
FIG. 7 is a side view of the present invention contacting a luggage rack on a vehicle.

In either case, an axle 50 is extended through both rollers 40, 44 and the lower opening 24 on the lower end 22 of the garage door arm 20 such that the rollers 40, 44 may freely rotate about the lower end 22 of the garage door arm 20 as shown in FIGS. 6 and 7. Spacers 54*a*, 54*b* may be utilized to ensure that the rollers 40, 44 are unobstructed and able to freely rotate without any contact with the garage door arm 20.

With the present invention fully assembled and installed, the garage door 17 may be used as normal. In a situation in which an obstruction 60 is present when the garage door 17 is opening or closing, the rollers 40, 44 will roll across the obstruction 60 and thus prevent any damage thereto. For example, if the hatch 62 of a vehicle 60 is left open when the garage door 17 is opening or closing, the rollers 40, 44 will push the hatch 62 down slightly and pass harmlessly over both the hatch 62 and the vehicle 60 without causing any damage as shown in FIGS. 6 and 7.

Figure 8:
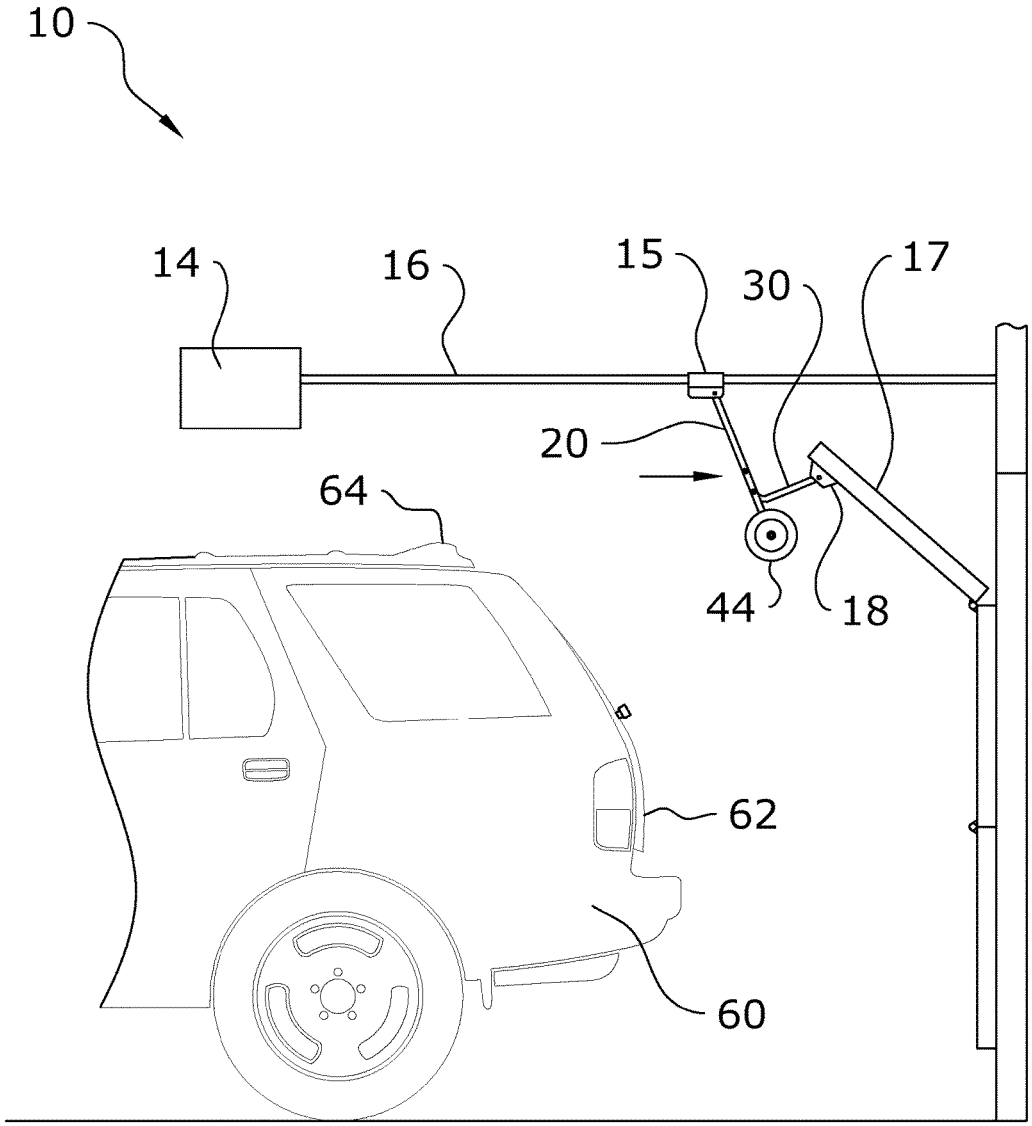
FIG. 8 is a side view of the present invention reversing the garage door after contacting the luggage rack.

If the rollers 40, 44 come across a structure which increases torque, such as contacting a luggage rack 64 as shown in FIG. 7, the garage door opener 14 itself will recognize the increased torque in most cases and reverse the garage door 17 as shown in FIG. 8. The rollers 40, 44 will prevent any damage both as the garage door 17 goes in a first direction and in a second direction by rolling across the hatch 62 and preventing the garage door arm 20 or any other structure from coming in contact therewith and causing damage such as scratches. The rollers 40, 44 will also in many cases move the obstruction 60 down and out of the way, such as shown in FIG. 8 in which the hatch 62 has been closed and will no longer obstruct the path of the garage door 17 on its next pass.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A garage door roller system, comprising:

a garage door;

a garage door opener comprising a track and a carriage movably secured to the track;

a garage door arm including an upper end and a lower end, wherein the upper end is directly connected to the carriage;

a connector including a first end and a second end, wherein the first end of the connector is directly connected to the garage door arm, wherein the second end of the connector is directly connected to the garage door; and a first wheel directly connected to the lower end of the garage door arm for rolling across a surface of an obstruction to prevent damage to the obstruction.

2. The garage door roller system of claim 1, wherein a portion of the first wheel extends below the lower end of the garage door arm.

3. The garage door roller system of claim 1, wherein the connector comprises a first portion and a second portion extending at a right angle with respect to the first portion.

4. The garage door roller system of claim 3, wherein the first portion of the connector is connected to the garage door arm and the second portion of the connector is connected to the garage door.

5. The garage door roller system of claim 4, comprising a second wheel connected to the lower end of the garage door arm.

6. The garage door roller system of claim 5, wherein the first wheel is connected to a first side of the garage door arm and the second wheel is connected to a second side of the garage door arm.

7. A garage door roller system, comprising:

a vehicle;

a garage door;

a garage door opener comprising a track and a carriage movably secured to the track;

a garage door arm including an upper end and a lower end, wherein the upper end of the garage door arm includes an opening, wherein the upper end of the garage door arm is directly and pivotally connected to the carriage by a fastener extending through the opening of the garage door arm;

a connector including a first end and a second end, wherein the connector is L-shaped, wherein the first end of the connector is directly connected to the garage door arm, wherein the second end of the connector is directly connected to the garage door;

a first wheel directly connected to a first side of the lower end of the garage door arm; and a second wheel directly connected to a second side of the lower end of the garage door arm;

wherein the first wheel and the second wheel are adapted to roll across a portion of the vehicle when the garage door is being opened or closed.

8. The garage door roller system of claim 7, wherein the portion of the vehicle comprises a hatch of the vehicle.

9. The garage door roller system of claim 7, wherein the first wheel and the second wheel each extend below the lower end of the garage door arm such that the first wheel and the second wheel prevent the garage door arm from contacting the portion of the vehicle.

* * * * *